United States Patent [19]

Ismail

[11] 4,362,905

[45] Dec. 7, 1982

[54] UNIVERSAL ADAPTERS FOR MODULAR PLUG TELEPHONES

[76] Inventor: Nassar Ismail, 10 Roberts St., #35, Sommerville, Mass. 02145

[21] Appl. No.: 116,471

[22] Filed: Jan. 29, 1980

[51] Int. Cl.[3] ..... H01R 27/02

[52] U.S. Cl. ..... 179/1 PC; 339/159 R

[58] Field of Search ..... 179/1 PC; 339/154 R, 339/154 A, 159 R, 99 R

[56] References Cited

U.S. PATENT DOCUMENTS

| | | | |
|---|---|---|---|
| 2,952,744 | 9/1960 | Semon | 179/1 PC |
| 3,876,273 | 4/1975 | Schwartz | 339/38 |
| 3,887,771 | 6/1975 | Spanel | 179/1 C |
| 4,047,787 | 9/1977 | Gumb et al. | 339/154 A |
| 4,050,768 | 9/1977 | Gumb | 339/154 A |
| 4,061,411 | 12/1977 | Gumb et al. | 179/1 PC |
| 4,129,350 | 12/1978 | Winn | 339/99 R |
| 4,178,062 | 12/1979 | Abbo | 339/154 A |

*Primary Examiner*—Joseph A. Popek

[57] ABSTRACT

The invention comprises a variety of unique adapters for use with modular plug telephones. The adapters permit multiple handsets or multiple telephones or any combination of both to be connected with a single telephone wall jack. The adapters comprise multiple jacks and plugs with suitable electric connections therein to provide the combination of telephones and handsets desired. In one embodiment the adapter combines multiple modular telephone plugs and jacks with a jack for the old style four prong telephone plug and an indicator light connection. In another embodiment a jack is provided for the connection of a tape recorder or other electronic equipment.

4 Claims, 16 Drawing Figures

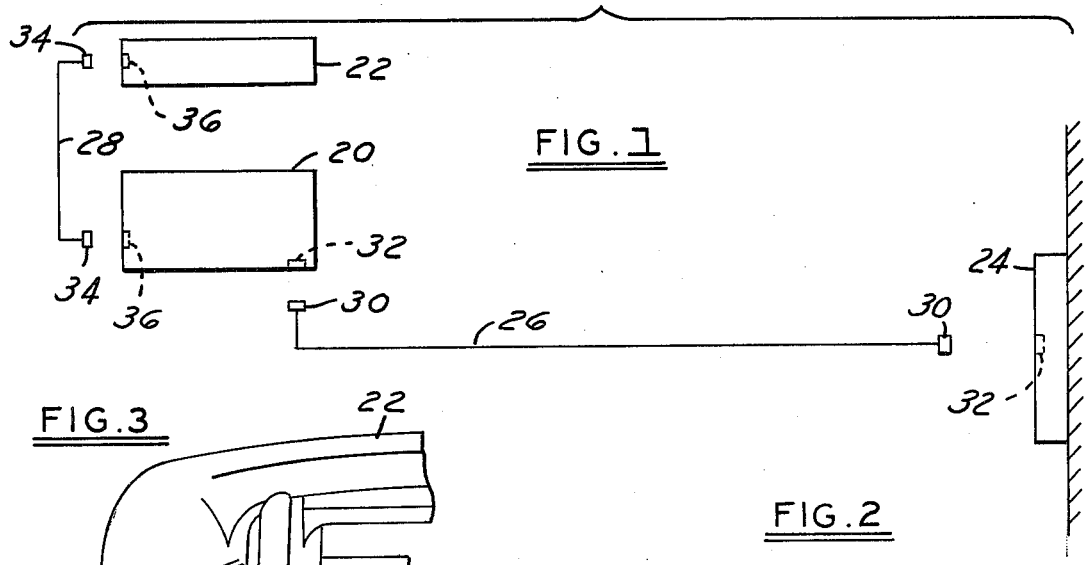
FIG. 1
FIG. 3
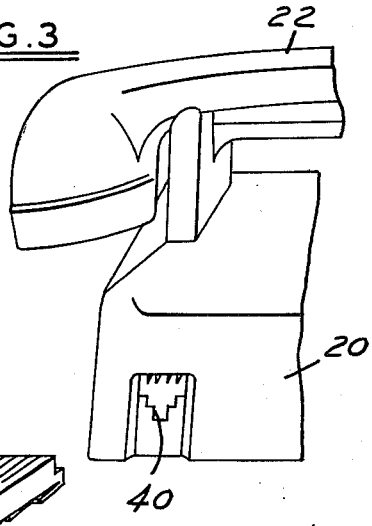
FIG. 2
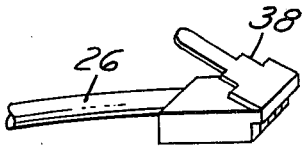
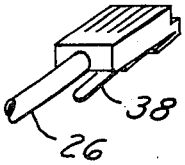
FIG. 4
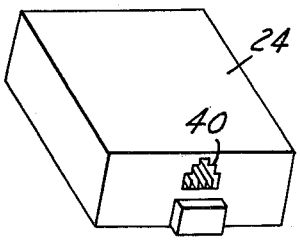
FIG. 5
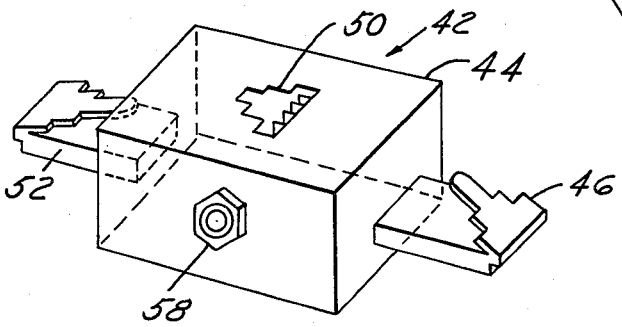
FIG. 6
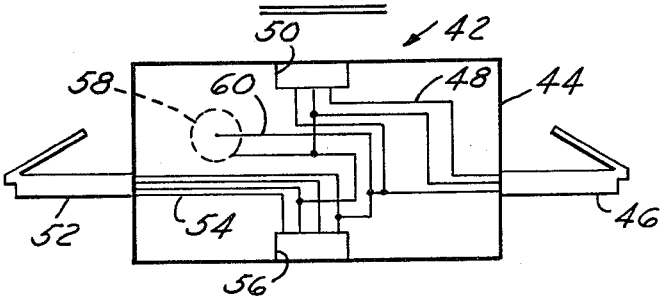

UNIVERSAL ADAPTERS FOR MODULAR PLUG TELEPHONES

BACKGROUND OF THE INVENTION

The field of the invention pertains to telephones and in particular telephones with modular plug and jack connections. For a number of years the familiar four prong plug and jack telephone connections have been in use in North America and many homes have been wired for such units. More recently modular plugs on the cords and jacks in the telephone units and headpieces have come into use. The new plugs and jacks are significantly smaller and more convenient.

U.S. Pat. Nos. 3,876,273, 4,047,787 and 4,050,768 disclose modern modular block and extension cord devices for electric and telephone connections. In particular U.S. Pat. No. 4,050,768 discloses an interconnector for adapting existing telephone wall outlets to the modern modular plug and jack connection. U.S. Pat. No. 4,047,787 discloses an extension cord for modular plug and jack telephones that permits two telephones to be connected in parallel to one jack. None of the above modular block and extension cord devices, however, permit a wide combination of telephones, handsets and recording devices to be interconnected for multiparty use as desired.

SUMMARY OF THE INVENTION

The invention comprises a variety of unique adapters or modular blocks for use with modular plug telephones. In one embodiment the adapter combines multiple modular telephone plugs and jacks with a jack for the older four prong telephone plug and an indicator light connection. In another embodiment a recording jack is joined with multiple modular jacks and a modular plug and in a third embodiment a modular four contact plug and jack are combined with a modular three contact plug and jack and a recording jack. The adapters permit multiple telephones or multiple handsets or any combination of both to be used together and with a recording device. Other connectors and extension cords are disclosed for use with the adapters.

DESCRIPTION OF THE DRAWINGS

FIG. 1 is a schematic of a single modular telephone connection;

FIG. 2 is a perspective of a modular telephone plug;

FIG. 3 is a partial perspective of a telephone with a modular jack and a plug;

FIG. 4 is a perspective of a modular telephone wall jack;

FIG. 5 is a perspective of a modular universal adapter;

FIG. 6 is a partial schematic of the universal adapter of FIG. 5;

DESCRIPTION OF THE PREFERRED EMBODIMENTS

Figure 7:
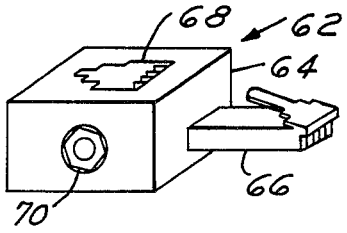
FIG. 7 is a perspective of an alternate form of modular universal adapter.

In FIGS. 1 through 4 a single telephone or base 20, handset 22 and wall outlet 24 are connected by a four wire modular cable circuit 26 and a wire modular cable circuit 28. The cable 26 includes a modular four contact plug 30 at each end engageable with the four contact jacks 32 in the telephone base 20 and wall outlet 24. Similarly, the cable 28 includes a modular contact plug 34 at each end engageable with the contact jacks 36 in the telephone base 20 and handset. The modular plugs 30 or 34 include spring clips 38 adapted to latch into retainers 40 in the respective jacks 32 and 36. The contact plugs and jacks of cable 28 and handset 22 are of a size different than that of cable 26 and outlet 24 to prevent improper interconnection. The base 20 includes jack 32 for cable 26 only and jack 36 for cable 28 only.

In FIGS. 5 and 6 an adapter generally denoted by 42 is shown comprising a block 44 having a modular three contact plug 46 electrically connected 48 to a modular three contact jack 50 and a modular four contact plug 52 electrically connected 54 to a modular four contact jack 56. The adapter 42 includes an auxiliary recorder jack 58 electrically connected 60 to the voice circuit of both the three contact connection 48 and the four contact connection 54. By inserting the adapter 42 into the three contact headset circuit 28 or alternatively into the four contact telephone to wall outlet circuit 26 and connecting a recorder to the auxiliary recording jack 58, recordings of telephone conversations can be made. The auxiliary recording jack 58 can also be used for an auxiliary indicator light or other electronic equipment.

Figure 8:
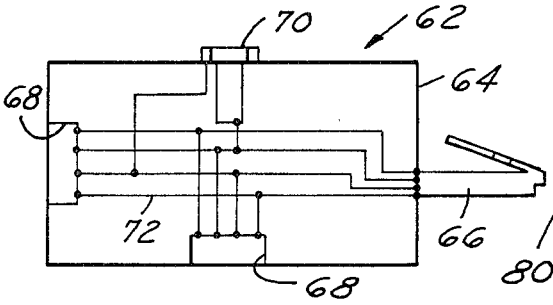
FIG. 8 is a partial schematic of the universal adapter of FIG. 7.

An alternative adapter generally denoted by 62 is shown in FIGS. 7 and 8. The adapter comprises a block 64 having a four contact plug 66 extending therefrom and two four contact jacks 68 therein. Additionally, a recording jack 70 is included in the block 64. All the jacks and the plug are electrically connected 72 in the block 64 as shown in FIG. 8. This adapter 62 permits two telephones and a recorder to be connected into the telephone jack 32.

Figure 9:
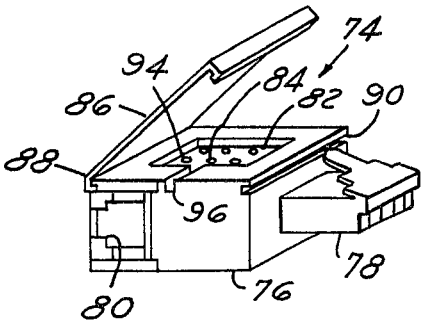
FIG. 9 is a perspective of a second alternate form of modular universal adapter.
Figure 10:
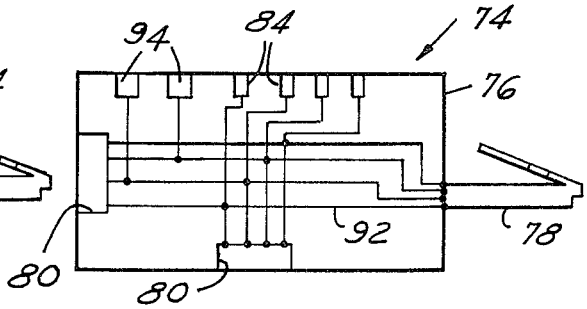
FIG. 10 is a partial schematic of the universal adapter of FIG. 9.

A second alternative adapter generally denoted by 74 is shown in FIGS. 9 and 10. The adapter comprises a block 76 having a four contact plug 78 extending therefrom and two four contact jacks 80 therein. The top of the block 76 includes a recessed area 82 having four sockets 84 placed in a pattern suitable for accepting a conventional four prong telephone plug. A cover 86 for the recessed area 82 is hinged and fastened at 88 to the block 76 and formed to latch in a slot 90 in the block 76. The two four contact jacks 80, the four contact plug 78 and the prong sockets 84 are electrically connected as shown at 92. Two wire clips or terminal screws 94 are included in the recessed area 82 for an optional indicator light to show voice transmission signals, a recording device or other use. A second slot 96 is formed in the block 76 to permit the wire or cable to the clips 94 and the prong sockets 84 to extend from the block with the cover 86 closed. This adapter 74 permits a conventional four prong plug telephone to be connected into the more modern modular telephone jack 32 as well as two modular plug telephones and an indicator light.

The adapters 62 and 74 disclosed above for four contact modular plugs and jacks can be constructed for three contact size modular plugs and jacks. Connected into the jack 36 and without the use of the four prong sockets 84, multiple handsets 22 can be used without the need for multiple telephone bases 20.

Figure 11:
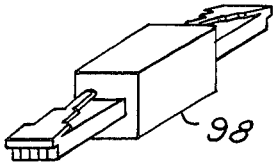
FIG. 11 is a perspective of a double ended plug coupler.
Figure 13:
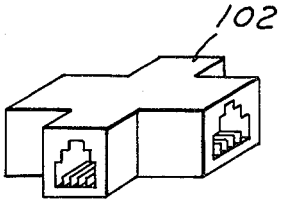
FIG. 13 is a perspective of a four-way jack coupler.
Figure 12:
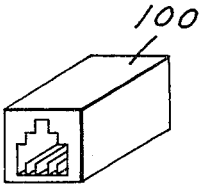
FIG. 12 is a perspective of a double ended jack coupler.
Figure 14:
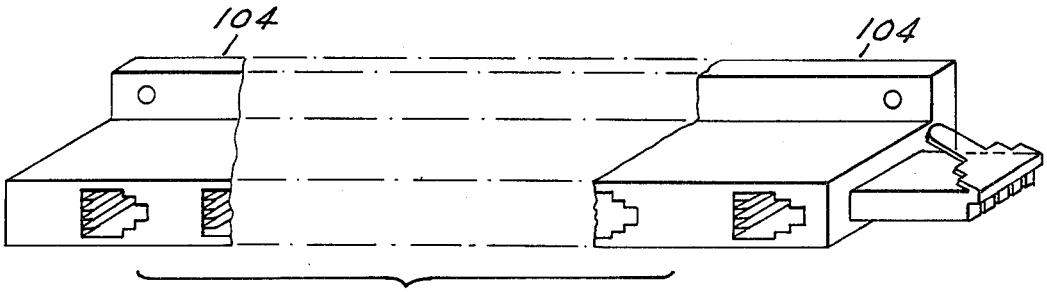
FIG. 14 is a perspective of a telephone jack strip.
Figure 15:
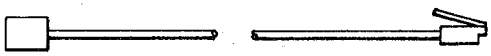
FIG. 15 is a side view of a modular plug and jack extension cord.
Figure 16:
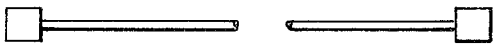
FIG. 16 is a side view of a modular double ended jack extension cord.

FIGS. 11 through 16 show couplers and extension cords for use with the modular plug and jack telephones. Any of these can be constructed for the four contact size plugs and jacks or the three contact size plugs and jacks. Couplers 98 and 100 in FIGS. 11 and 12 are to convert a jack to a plug and vice versa. The four way coupler 102 in FIG. 13 provides connection for three telephones and the terminal strip 104 of FIG. 14 provides multiple jacks for multiple telephones or handsets. FIGS. 15 and 16 show extension cords with a jack and plug in the former and a jack at each end in the latter. By combining the adapters, couplers and extension cords, multiple telephone or multiple handset combinations or combinations of both can be created as desired.

As an example, a four wire terminal strip 104 plug can be inserted into the four contact jack 56 in the adapter block 44 and the adapter block plug 52 inserted into the four contact wall outlet 24 jack 32. A plurality of telephone bases 20 can then be connected in parallel to the jacks in terminal strip 104 by a plurality of cables 26 with modular plugs 30 at each end. The result is a very inexpensive means for connecting multiple phones and a recording device to a single line.

As a second example that eliminates the need for separate telephone bases 20, a three wire terminal strip 104 plug can be inserted into the three contact jack 50 in the adapter block 44 and the adapter block plug 46 inserted into the three contact jack 36 of a single telephone base 20. A plurality of handsets 22 can be each connected by a three wire cable 28 with modular plugs 34 at each end to a jack in the terminal strip 104. Further cost savings are the result.

I claim:

1. A telephone modular plug and jack adapter comprising a block, at least two modular plugs extending from the block, at least two modular jacks in the block, and a recording jack in the block wherein a first one of the modular jacks and a first one of the modular plugs each include four wire contacts and are electrically connected together in parallel, a second one of the modular plugs and second one of the modular jacks each include three wire contacts and are electrically connected together in parallel, and the recording jack has two electrical contacts and is connected electrically in parallel to two parallel connections of the four wire plug and jack and to two parallel connections of the three wire plug and jack.

2. In a modular telephone system including modular three wire plug and jack connections from handsets to telephone bases and modular four wire plug and jack connections from telephone bases to one or more wall outlets, a modular plug and jack adapter block, at least two modular plugs extending from the block, at least two modular jacks in the block, and a recording jack in the block wherein a first one of the modular jacks and a first one of the modular plugs each include four wire contacts and are electrically connected together in parallel, a second one of the modular plugs and second one of the modular jacks include three wire contacts and are electrically connected together in parallel, and the recording jack has two electrical contacts and is connected electrically in parallel to two parallel connections of the four wire plug and jack and to two parallel connections of the three wire plug and jack, the adapter block being selectably inserted in either one three wire circuit or one four wire circuit of the system.

3. The telephone system of claim 2 including a four wire multiple modular jack terminal strip with a single modular plug extending therefrom and a plurality of four wire modular plug ended extension cords, said terminal strip modular plug inserted into a four wire jack in the adapter block, the adapter block four wire plug being inserted into a wall outlet four wire modular jack, and each of said plurality of modular plug ended extension cords plugged into each of a plurality of telephone bases and into one of said terminal strip jacks.

4. The telephone system of claim 2 including a three wire multiple modular jack terminal strip with a single modular plug extending therefrom and a plurality of three wire modular plug ended extension cords, said terminal strip modular plug inserted into a three wire jack in the adapter block, the adapter block three wire plug being inserted into the telephone base three wire modular jack, and each of said plurality of modular plug ended extension cords plugged into each of a plurality of telephone handsets and into said terminal strip jacks.

* * * * *